US012313362B2

(12) United States Patent
Furusho

(10) Patent No.: US 12,313,362 B2
(45) Date of Patent: May 27, 2025

(54) LOW RECOIL FIREARM

(71) Applicant: Akihisa Furusho, Tajimi (JP)

(72) Inventor: Akihisa Furusho, Tajimi (JP)

( * ) Notice: Subject to any disclaimer, the term of this patent is extended or adjusted under 35 U.S.C. 154(b) by 0 days.

(21) Appl. No.: 18/527,376

(22) Filed: Dec. 4, 2023

(65) Prior Publication Data

US 2025/0067532 A1 Feb. 27, 2025

(30) Foreign Application Priority Data

Aug. 21, 2023 (JP) ..... 2023-133912

(51) Int. Cl.
*F41A 21/36* (2006.01)

(52) U.S. Cl.
CPC ..... *F41A 21/36* (2013.01)

(58) Field of Classification Search
CPC ..... F21A 21/36; F21A 21/38
USPC ..... 42/1.06; 89/157, 165, 14.3
See application file for complete search history.

(56) References Cited

U.S. PATENT DOCUMENTS

| | | | | |
|---|---|---|---|---|
| 4,492,050 | A * | 1/1985 | Kagehiro | F41A 21/28 42/1.06 |
| 4,503,632 | A * | 3/1985 | Cuevas | F41A 21/28 42/1.06 |
| 10,048,028 | B2 * | 8/2018 | Furusho | F41A 5/10 |
| 10,415,907 | B1 * | 9/2019 | Kincel | F41A 3/84 |
| 11,378,347 | B2 * | 7/2022 | Kincel | F41A 3/84 |
| 11,656,042 | B2 * | 5/2023 | Durham, III | F41A 3/70 42/1.06 |
| 2014/0059909 | A1 * | 3/2014 | Caudle | F41A 3/84 42/1.06 |
| 2014/0075798 | A1 * | 3/2014 | Kincel | F41A 3/84 42/1.06 |

FOREIGN PATENT DOCUMENTS

JP 2017-129306 A 7/2017

* cited by examiner

*Primary Examiner* — Samir Abdosh
(74) *Attorney, Agent, or Firm* — Yokoi & Co., U.S.A.; Toshiyuki Yokoi

(57) ABSTRACT

A low recoil firearm 1 provided with counterweights 22, the number of counterweights 22*a*, 22*b* is two or more, and a kinetic energy of the bullet received by a barrel 11 is transferred and distributed to the counterweights 22*a*, 22*b*. A stop mechanism separately stops the counterweights 22*a*, 22*b* from each other. Although the kinetic energy transmitted to one counterweight is eliminated in the conventional technology, the kinetic energy distributed to two counterweights 22*a*, 22*b* is eliminated in the present invention.

11 Claims, 23 Drawing Sheets

LOW RECOIL FIREARM

CROSS-REFERENCE TO RELATED APPLICATIONS

This patent specification is based on Japanese patent application, No. 2022-0133912 filed on Aug. 21, 2023 in the Japan Patent Office, the entire contents of which are incorporated by reference herein.

PRIOR ART

[Patent Document 1] Japanese unexamined patent application publication No. 2017-129306

BACKGROUND OF THE INVENTION

The present invention relates to a low recoil firearm. In particular, the present invention relates to a low recoil firearm provided with counterweights.

In firearms such as a gun, recoil is caused when shooting a bullet. The gun having a counterweight for reducing the recoil is known.

In a low recoil firearm shown in Patent Document 1, the recoil is reduced by transmitting the recoil of a barrel to the counterweight when the bullet is shot.

SUMMARY OF THE INVENTION

When the bullet is shot, a kinetic energy of the bullet received by the barrel is transmitted to the counterweight. However, the kinetic energy received by the counterweight should be eliminated. It cannot be said that the process of eliminating the kinetic energy received by the counterweight in the conventional low recoil firearm is optimum.

The present invention further reduces the recoil of the low recoil firearm having the counterweight.

The present information relates to a low recoil firearm provided with counterweights, the number of the counterweights is two or more, and a stop mechanism for separately stopping each of the counterweights is provided.

In the above described configuration, the number of the counterweights is two or more, the kinetic energy of the bullet received by the barrel is transferred and distributed to each of the counterweights. The stop mechanism separately stops each of the counterweights. Although the kinetic energy transmitted to one counterweight is eliminated in the conventional technology, the kinetic energy distributed to two counterweights 22*a*, 22*b* is eliminated in the present invention.

Since the kinetic energy distributed to a plurality of counterweights is eliminated in the low recoil firearm of the present invention, the recoil can be further reduced compared to the firearm provided with a single counterweight.

DETAILED DESCRIPTION OF THE INVENTION

Hereafter, embodiments of the present invention will be explained based on the drawings.

Figure 1:
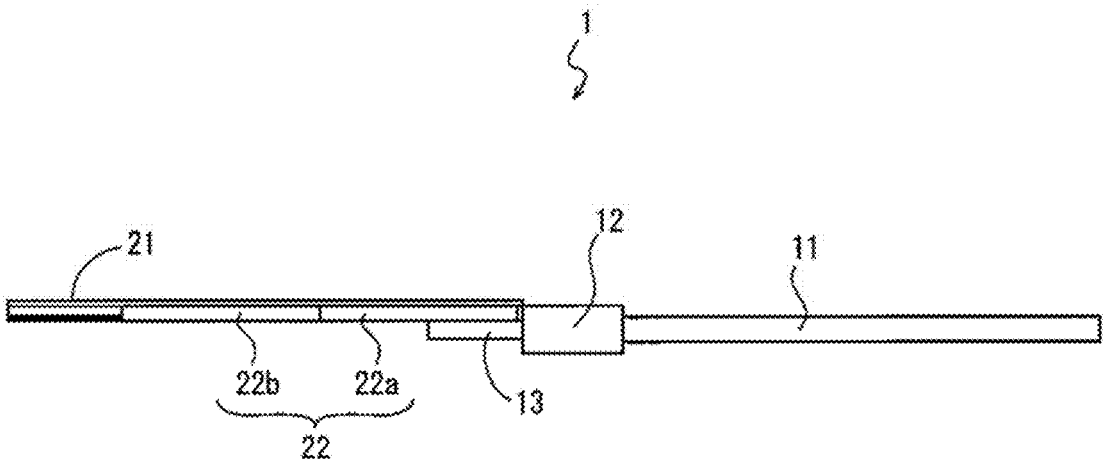
FIG. 1 is a schematic diagram of an initial state of a low recoil firearm concerning an embodiment of the present invention.
Figure 2:
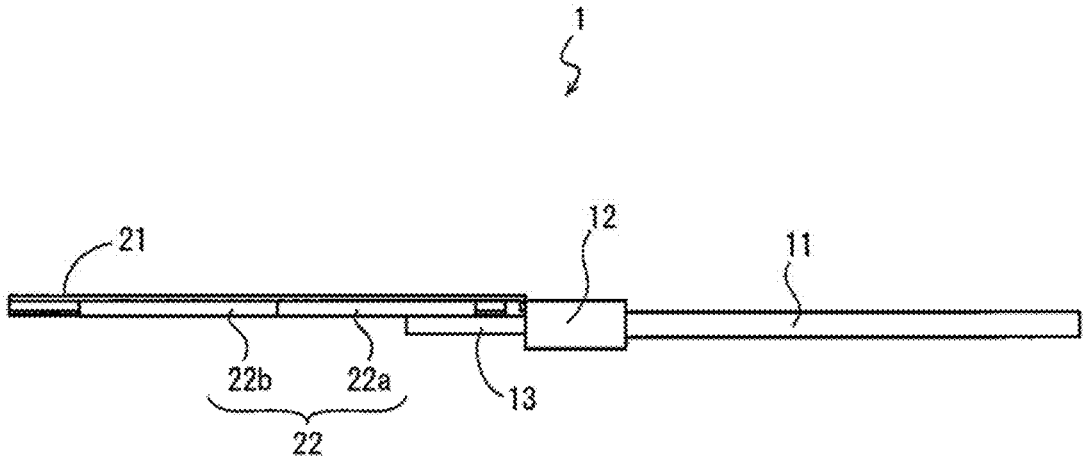
FIG. 2 is a schematic diagram of an intermediate state of the low recoil firearm of the embodiment.
Figure 3:
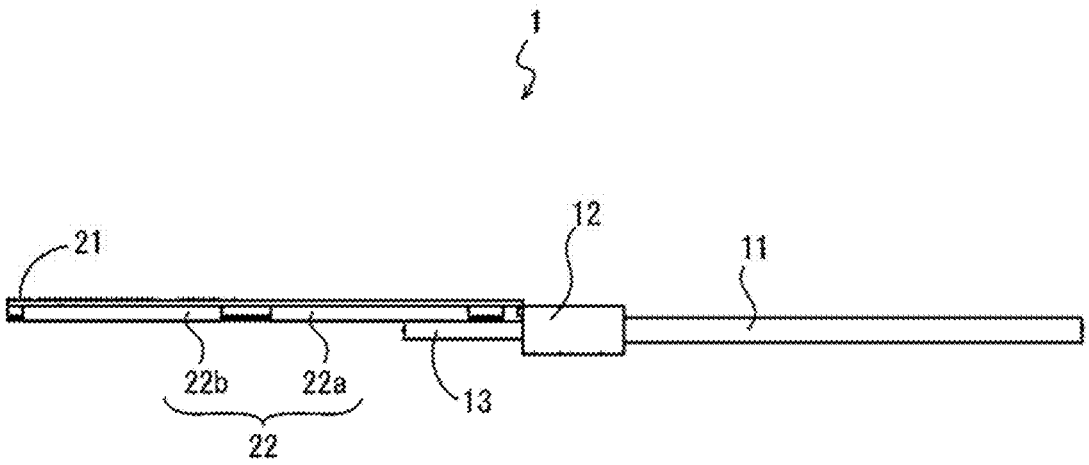
FIG. 3 is a schematic diagram of a stopped state of the low recoil firearm of the embodiment.

FIG. 1 to FIG. 3 show a low recoil firearm of an embodiment of the present invention by a schematic diagram. FIG. 1 shows an initial state, FIG. 2 shows an intermediate state and FIG. 3 shows a stopped state.

In the drawings, a low recoil firearm 1 is the low recoil firearm provided with counterweights. A shooting port is provided on a barrel 11 of the low recoil firearm 1 at the right side in the drawings. The direction of opening the shooting port is called the front direction, while the direction toward the cartridge chamber is called the rear direction. The barrel 11 is supported by a part 12 of a frame so as to be movable in the front-rear direction. When a bullet is shot (fired), the barrel 11 is configured to receive a recoil (reaction) leftward in the drawings.

Figure 4:
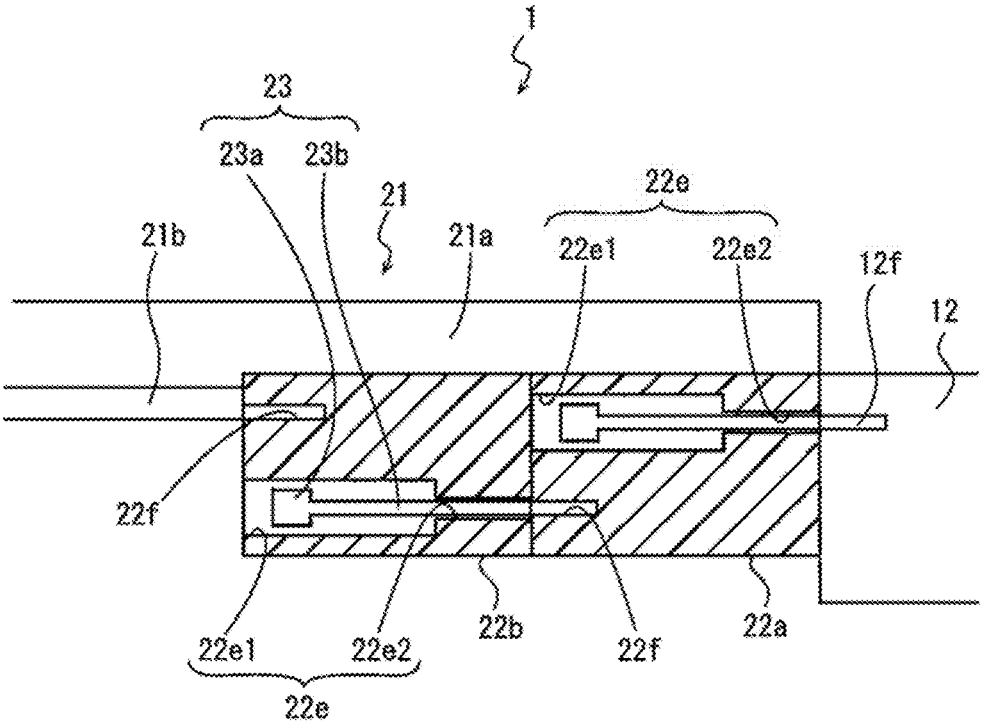
FIG. 4 is a schematic diagram of the initial state simply for showing an operation principle of the low recoil firearm of the embodiment.
Figure 5:
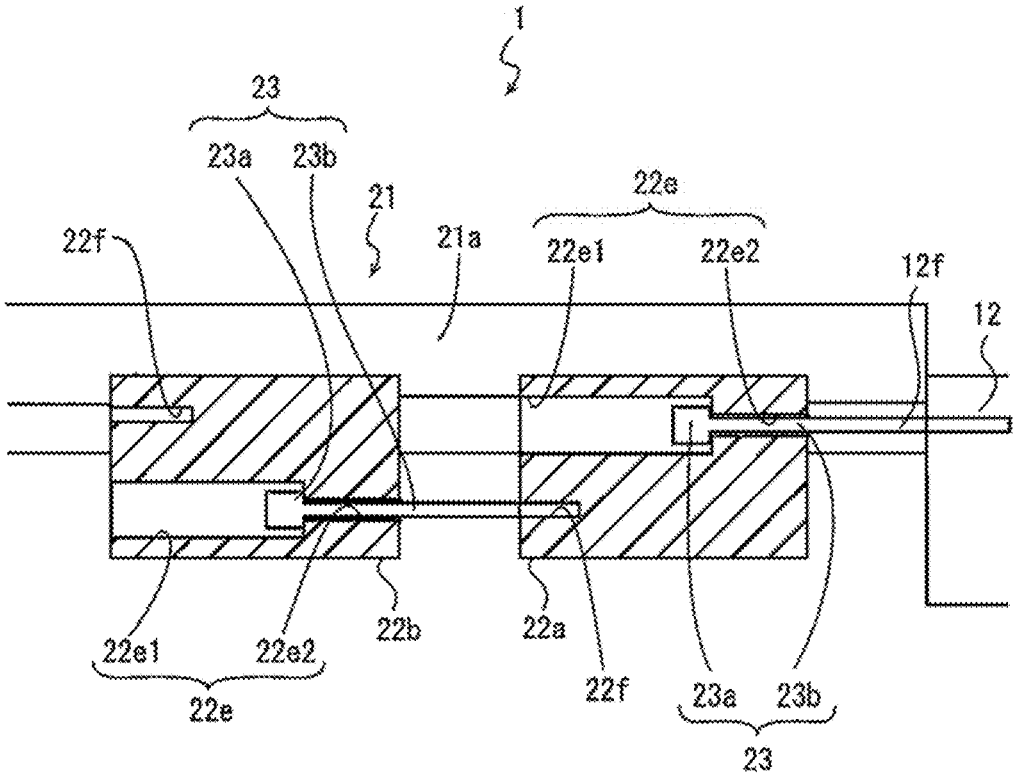
FIG. 5 is a schematic diagram of the stopped state for simply showing the operation principle of the low recoil firearm of the embodiment.
Figure 6:
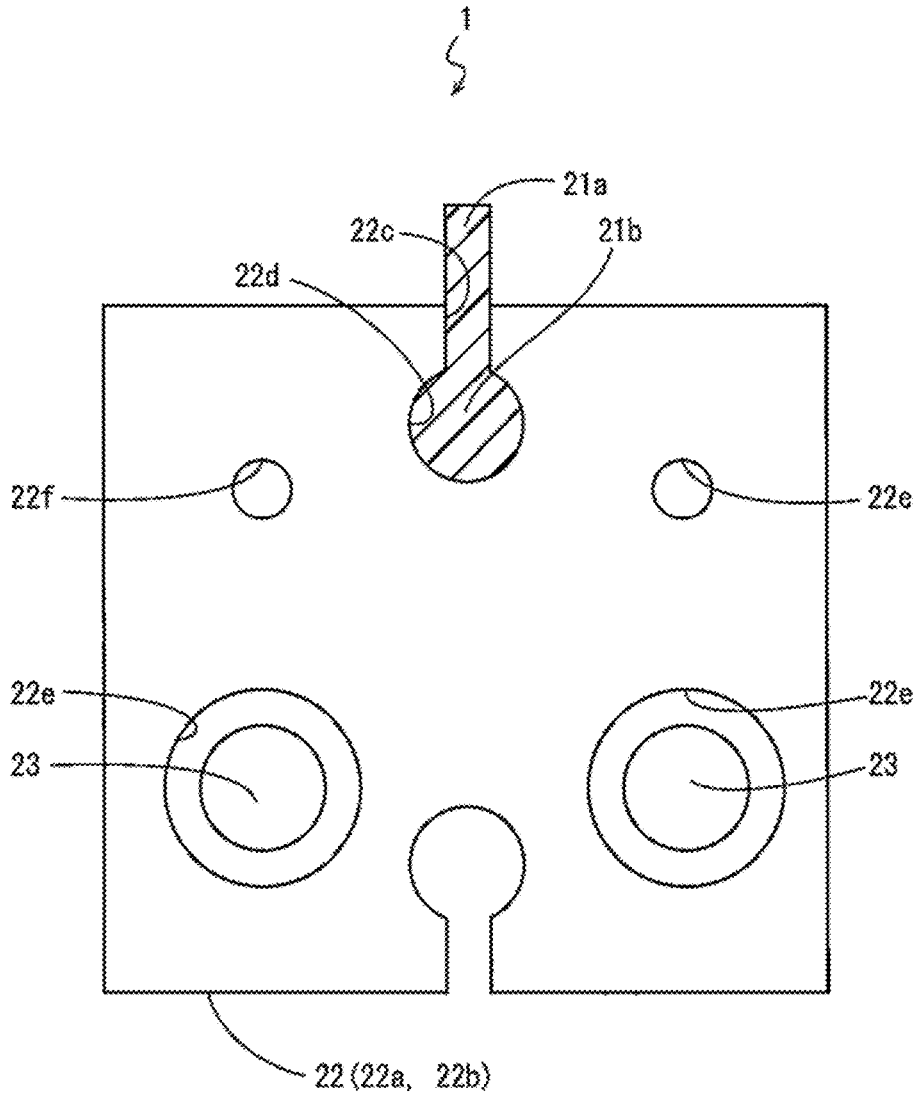
FIG. 6 is a front view of a counterweight for simply showing the operation principle of the low recoil firearm of the embodiment.

A slide rail 21 is arranged on a rear of the barrel 11 and counterweights 22 (22*a*, 22*b*) are supported by the slide rail 21 so that the counterweights 22 are slidable in the front-rear direction within a predetermined range. Note that a bolt 13 is arranged on a rear of the barrel 11. In addition, FIG. 4 to FIG. 6 simply show the operation principle by a schematic diagram. FIG. 4 shows the initial state and FIG. 5 shows the stopped state. FIG. 6 shows the counterweight by a front view. For simply showing the configuration, the shape of the counterweight is simplified.

The counterweights 22*a*, 22*b* are the members identical to each other and vertically reversed in the attached state. The slide rail 21 includes a planar portion 21*a*. The slide rail 21 is fixed to a not-illustrated frame or the like at an upper part of the planar portion 21*a*. A columnar portion 21*b* having a circular cross-section is formed on a lower end of the planar portion 21*a*.

The counterweights 22 (22*a*, 22*b*) has a rectangular column shape as a whole. A groove 22*c* recessed inward is formed on the upper surface and the lower surface of the counterweights 22 in the center of the width direction so that the planar portion 21*a* of the slide rail 21 is inserted into the groove 22*c*. A circular recessed portion 22*d* is formed in the inner part of the groove 22*c* so that the columnar portion 21*b* of the slide rail 21 can be inserted into the circular recessed portion 22*d*. The width of the groove 22*c* is smaller than the diameter of the columnar portion 21*b*. The length of the groove 22*c* is slightly shorter than the length of the planar portion 21*a*. Therefore, the slide rail 21 can be inserted into the counterweights 22*a*, 22*b* in the front-rear direction. When the slide rail 21 is inserted into the counterweights 22*a*, 22*b*, the slide rail 21 can suspend and support the counterweights 22 (22*a*, 22*b*) in a state of being slidable in the length direction.

Through holes 22*e*, 22*e* are penetrated through the counterweights 22 in the front-rear direction at a left and a right symmetrical position. The through holes 22*e* are formed by a large diameter portion 22*e*1 having a large diameter located at the rear side and a small diameter portion 22*e*2 having a smaller diameter located at the front side. A bolt 23 is inserted into each of the through holes 22*e* from the rear side. A head portion 23*a* of the bolt 23 is inserted into the boundary surface between the small diameter portion 22*e*2 and the large diameter portion 22*e*1. Only a screw portion 23*b* penetrates through the small diameter portion 22*e*2.

When the counterweight 22*a* and the counterweight 22*b* are arranged in the front-rear direction in a state that the up-down directions are reversed from each other, a female screw hole 22*f* is formed at a portion facing the small diameter portion 22*e*2 of the through holes 22*e* so that the screw portion 23*b* can be inserted into the female screw hole 22*f*. Therefore, the bolt 23 is inserted from the large diameter portion 22*e*1 and the screw portion 23*b* penetrating through the small diameter portion 22*e*2 and protruding from the small diameter portion 22*e*2 can be screwed into the female screw hole 22*f*.

In addition, a female screw hole 12*f* is formed on the part 12 of the frame in the similar position. Therefore, the screw portion 23*b* of the bolt 23 penetrating through the counterweight 22*a* adjacent to the barrel 11 can be screwed with the female screw hole 12*f*.

The length of the screw portion 23*b* is slightly longer than the length of the small diameter portion 22*e*2 of the through holes 22*e*. In the initial state, the counterweight 22*a* is located at the position abutting on the part 12 of the frame, and the counterweight 22*b* is located at the position abutting on the counterweight 22*a*. The counterweight 22*b* is stopped when the counterweight 22*b* is separated from the counterweight 22*a* for the length where the screw portion 23*b* is longer than the small diameter portion 22*e*2. The counterweight 22*a* is stopped when the counterweight 22*a* is separated from the part 12 of the frame for the same difference of the length.

As described above, the plurality of counterweights 22*a*, 22*b* are slidably connected with each other so that the plurality of counterweights 22*a*, 22*b* can be separated from each other by a predetermined distance in a moving direction. Accordingly, the stop mechanism is formed by the through holes 22*e*, the bolt 23, the female screw holes 22*f*, 12*f* and the like.

In the above described example, since the length of the bolt 23 is longer than the length of the small diameter portion 22*e*2, the counterweights 22*a*, 22*b* are moved from the state of being in contact with each other to the state of being separated from each other by a predetermined length. Directly, the counterweights 22*a*, 22*b* are stopped when the head portion 23*a* abuts on the boundary surface between the large diameter portion 22*e*1 and the small diameter portion 22*e*2. In this case, the counterweights 22 are stopped when the counterweights 22 collide with a stopper member formed by the bolt 23, the through holes 22*e* and the like.

On the other hand, it is not necessary to stop the counterweights 22 immediately after the head portion 23*a* abuts on the boundary surface between the large diameter portion 22*e*1 and the small diameter portion 22*e*2. For example, it is possible to make the head portion 23*a* of the bolt 23 slide on the inner surface of the large diameter portion 22*e*1 or interpose a sliding material between the head portion 23*a* and the inner surface so that a resistance is generated when the bolt 23 slides in the large diameter portion 22*e*1. In the above described case, the counterweights 22 are stopped by making the counterweights 22 slide on the stopper member formed by the bolt 23, the through holes 22*e* and the like.

It is also possible to make the counterweights 22 slide on the stopper member and then collide with the stopper member.

In the above described example, the counterweights 22*a*, 22*b* are connected with each other and the counterweights 22*a*, 22*b* are stopped by mutually acting with each other. It is also possible to provide a plurality of protrusions on the slide rail 21 at the positions where the counterweights 22*a*, 22*b* are stopped so that each of the counterweights 22*a*, 22*b* abuts on each of the protrusions when each of the counterweights 22*a*, 22*b* is moved rearward from the initial position. Namely, it is possible to make each of the counterweights 22*a*, 22*b* abut on each of the protrusions to independently stop each of the counterweights 22*a*, 22*b* instead of stopping the counterweights 22*a*, 22*b* by mutually acting with each other.

Returning to FIG. 1 to FIG. 3, FIG. 1 to FIG. 3 show the low recoil firearm concerning an embodiment of the present invention by a schematic diagram. FIG. 1 shows the initial state, FIG. 2 shows the intermediate state and FIG. 3 shows the stopped state.

As shown in FIG. 1, when the bullet is shot by the low recoil firearm 1, the barrel 11 receives the recoil and begins to move rearward. Because of this, the barrel 11 pushes the counterweight 22*a* with which a part of the barrel 11 is contacted rearward. At this time, the recoil of the barrel 11 is transferred to the counterweight 22*a*. Since the counterweight 22*b* is in contact with the counterweight 22*a*, the transferred kinetic energy is distributed to the counterweight 22*a* and the counterweight 22*b*. Then, the counterweight 22*a* and the counterweight 22*b* independently begin to move rearward by the recoil transferred respectively to each of the counterweight 22*a* and the counterweight 22*b*.

FIG. 2 shows the state where the counterweight 22*a* is separated from the part 12 of the frame by the above described length. Before the counterweight 22*a* reaches the above described position, the counterweight 22*a* is slid without receiving any restriction. However, when the counterweight 22*a* reaches the above described position, the head portion 23*a* of the bolt 23 abuts on the boundary surface between the large diameter portion 22*e*1 and the small diameter portion 22*e*2 of the through holes 22*e*. Thus, the counterweight 22*a* cannot move anymore and the counterweight 22*a* stops at the above described position. In other words, the first counterweight 22*a* in a plurality of counterweights 22 is stopped by the stop mechanism. Although the counterweight 22*a* pulls the part 12 of the frame rearward to stop the counterweight 22*a*, time difference occurs after the bullet is shot and the recoil is distributed. Consequently, the recoil is low.

On the other hand, the counterweight 22*b*, which receives the recoil separately from the counterweight 22*a*, continues to move rearward. FIG. 3 shows the state that the counterweight 22*b* is separated from the already stopped counterweight 22*a* by the above described length. Before the counterweight 22*b* reaches the above described position, the counterweight 22*b* is slid without receiving any restriction. However, when the counterweight 22*b* reaches the above described position, the head portion 23*a* of the bolt 23 abuts on the boundary surface between the large diameter portion 22*e*1 and the small diameter portion 22*e*2 of the through holes 22*e*. Thus, the counterweight 22*b* cannot move anymore and the counterweight 22*b* stops at the above described position. In other words, the second counterweight 22*b* in a plurality of counterweights 22 is stopped by the stop mechanism. Although the counterweight 22*b* pulls the counterweight 22*a* and the part 12 of the frame rearward to absorb the recoil, there is a time delay between the bullet being fired and the counterweights being stopped. As a result, the recoil is distributed and the recoil is minimized.

As described above, the number of the counterweights 22 is two or more and the stop mechanism formed by the through holes 22*e*, the bolt 23 and the female screw holes 22*f*, 12*f* is provided for separately stopping each of the counterweights 22 (22*a*, 22*b*).

In the low recoil firearm shown in FIG. 1 to FIG. 6, the weights of two counterweights 22*a*, 22*b* are equal. Namely, the weights of the plurality of counterweights are equal to each other. When the above described configuration is adopted, the kinetic energy of the recoil is approximately uniformly distributed.

Figure 7:
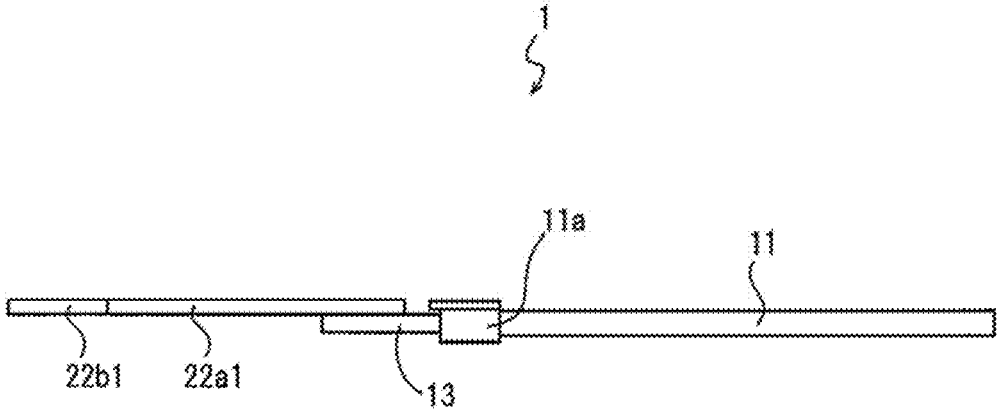
FIG. 7 is a schematic diagram of the initial state of the low recoil firearm concerning a modified example.
Figure 8:
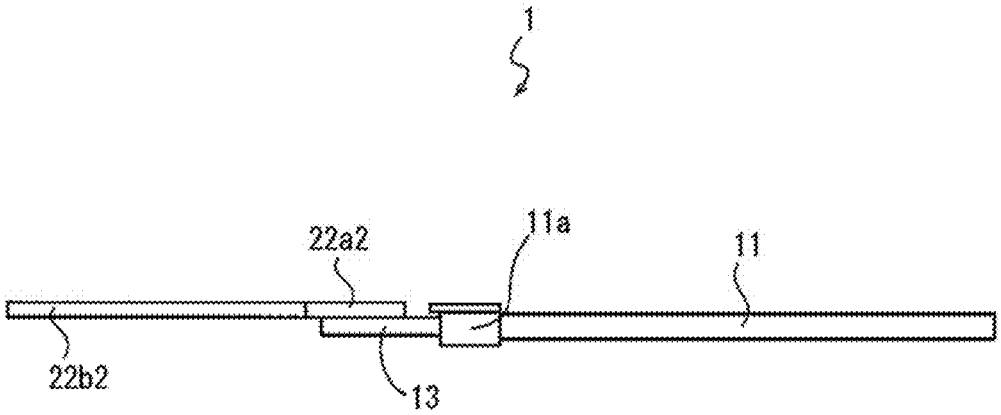
FIG. 8 is a schematic diagram of the initial state of the low recoil firearm concerning a modified example.

FIG. 7 and FIG. 8 are schematic diagrams of the initial state of the low recoil firearm concerning a modified example.

In the modified example shown in FIG. 7, the weight of the counterweight 22*a*1 located nearer to the barrel 11 is greater than the weight of the counterweight 22*b*1 further from the barrel 11. In the modified example shown in FIG. 8, the weight of the counterweight 22*a*2 located nearer to the barrel 11 is smaller than the weight of the counterweight 22*b*2 further from the barrel 11. Namely, the weights of the plurality of counterweights are different from each other. Note that the part 12 of the frame is not illustrated and a barrel rear end 11*a* slidably supported at this portion is illustrated in the figures.

As described above, the recoil when the bullet is shot is transferred to the plurality of counterweights in the distributed state and the counterweights are stopped by the stop mechanism at a minute interval from each other. When the counterweights are stopped, the user of the low recoil firearm should receive the distributed recoil in some way. When the weight of the counterweight stopped first is greater or smaller than the weight of the counterweight stopped later, the manner of receiving the distributed recoil varies. Consequently, handlability of the low recoil firearm can be adjusted.

Figure 9:
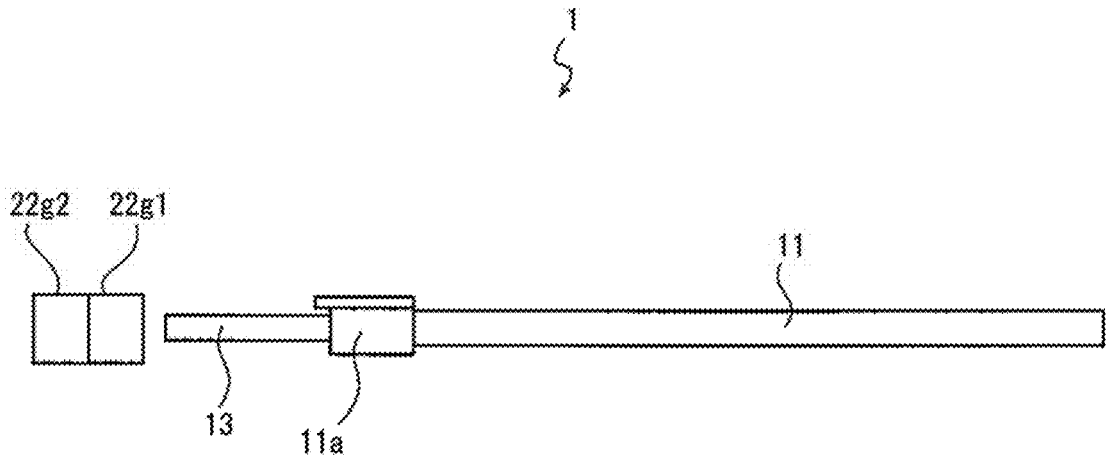
FIG. 9 is a schematic diagram of the initial state of the low recoil firearm concerning a modified example.
Figure 10:
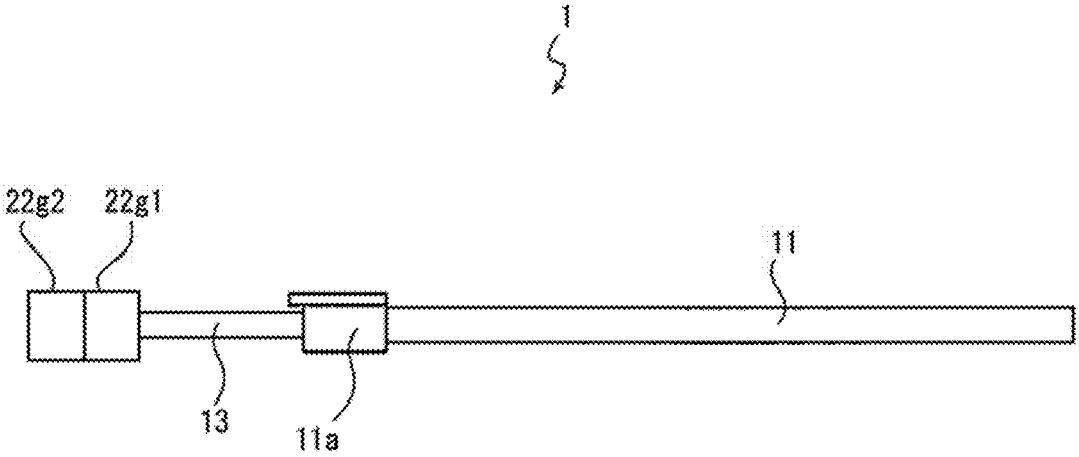
FIG. 10 is a schematic diagram of an intermediate state of the low recoil firearm of the modified example.
Figure 11:
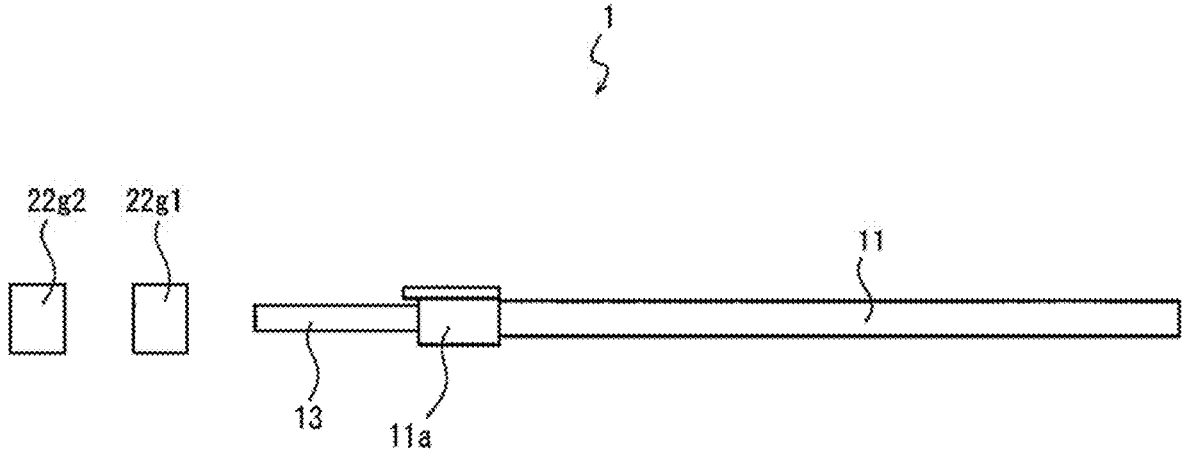
FIG. 11 is a schematic diagram of an intermediate state of the low recoil firearm of the modified example.

FIG. 9 to FIG. 11 show the low recoil firearm concerning a modified example by a schematic diagram. FIG. 9 shows the initial state, FIG. 10 shows the intermediate state and FIG. 11 shows the stopped state.

In this modified example, the weight of counterweights 22*g*1, 22*g*2 is greater than the weight of the counterweights 22*a*, 22*b*. Although not shown in the figures, a slide rail is provided and the stop mechanism similar to the modified example shown in FIG. 4 to FIG. 6 is provided.

As shown in FIG. 9, the counterweights 22*g*1, 22*g*2 are almost in contact with each other and slightly separated from the bolt 13 in the initial state.

As shown in FIG. 10, when the bullet is shot, the barrel 11 receives the recoil and retreats together with the bolt 13 located at the rear end. Thus, the bolt 13 located at the rear end abuts on the counterweight 22*g*1 located near the barrel 11. As a result, the counterweights 22*g*1, 22*g*2, which are almost in contact with each other, receive the recoil. Thus, the rearward-moving kinetic energy can be transferred. Accordingly, the counterweights 22*g*1, 22*g*2 begin to move rearward in a state of being almost in contact with each other.

FIG. 11 shows the stopped state. Before reaching the stopped state, two counterweights 22*g*1, 22*g*2 move rearward in a state of being almost in contact with each other and then the counterweight 22*g*1 stops first and the counterweight 22*g*2 stops after a short period of time. As shown in FIG. 11, the two counterweights 22*g*1, 22*g*2 are stopped with a time difference and located at the positions separated from each other.

Since the weight of the counterweights 22*g*1, 22*g*2 is large, greater recoil can be transferred to the counterweights. Consequently, the adjustment can be performed in accordance with the recoil, which varies depending of the bullet.

Figure 12:
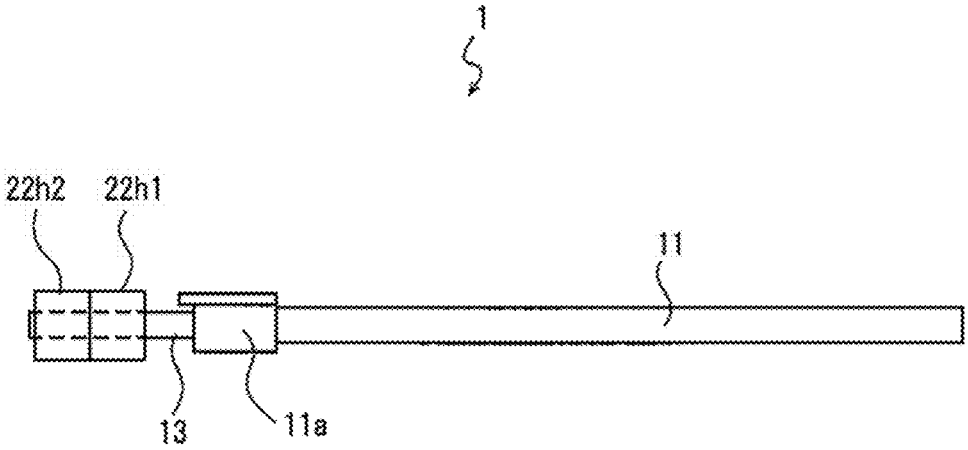
FIG. 12 is a schematic diagram of the initial state of the low recoil firearm concerning a modified example.
Figure 13:
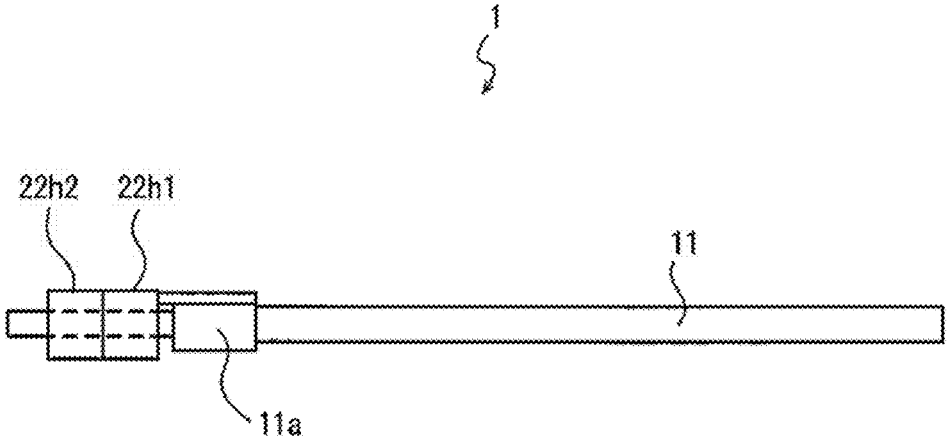
FIG. 13 is a schematic diagram of the intermediate state of the low recoil firearm of the modified example.
Figure 14:
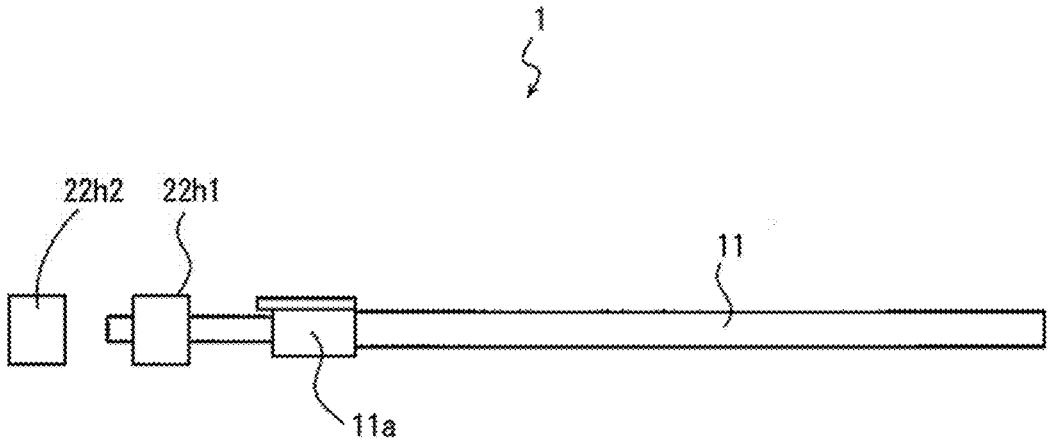
FIG. 14 is a schematic diagram of the stopped state of the low recoil firearm of the modified example.

FIG. 12 to FIG. 14 show the low recoil firearm concerning a modified example by a schematic diagram. FIG. 12 shows the initial state, FIG. 13 shows the intermediate state and FIG. 14 shows the stopped state.

In this modified example, counterweights 22*h*1, 22*h*2 are formed in an approximately ring-shape to surround the bolt 13 by the counterweights 22*h*1, 22*h*2. Since the bolt 13 penetrates through the counterweights 22*h*1, 22*h*2, the slide rail is not required. In addition, the stop mechanism similar to the modified example shown in FIG. 4 to FIG. 6 is provided.

As shown in FIG. 12, the counterweights 22*h*1, 22*h*2 are stopped in a state of being almost in contact with each other while surrounding the bolt 13 in the initial state. In addition, the counterweights 22*h*1, 22*h*2 are slightly separated from the barrel rear end 11*a*.

As shown in FIG. 13, when the bullet is shot, the barrel 11 receives the recoil and retreats together with the bolt 13 located at the rear end. Thus, the barrel located at rear end 11*a* abuts on the counterweight 22*h*1 located near the barrel 11. As a result, the counterweights 22*h*1, 22*h*2, which are almost in contact with each other, receive the recoil. Thus, the kinetic energy moving rearward can be transferred. Accordingly, the counterweights 22*h*1, 22*h*2 begin to move rearward in a state of being almost in contact with each other.

FIG. 14 shows the stopped state. Before reaching the stopped state, two counterweights 22*h*1, 22*h*2 move rearward in a state of being almost in contact with each other and then the counterweight 22*h*1 stops first and the counterweight **22*h*2 stops after a minute time. As shown in FIG. 14, the two counterweights 22*h*1, 22*h*2** are stopped with a time difference and located at the positions separated from each other.

The counterweights **22*h*1, 22*h*2 receive the recoil while surrounding the bolt 13 and the counterweights 22*h*1, 22*h*2 stop after that. Namely, a plurality of counterweights is arranged surrounding the axial line of the trajectory. Consequently, the counterweights 22*h*1, 22*h*2 are located at the position surrounding the axial line of the trajectory when the barrel 11 transmits the recoil to the counterweights 22*h*1, 22*h*2 and when the counterweights 22*h*1, 22*h*2 are stopped. Thus, the barrel 11** is not displaced from the axial line of the trajectory and the trajectory of the bullet is not affected.

Figure 15:
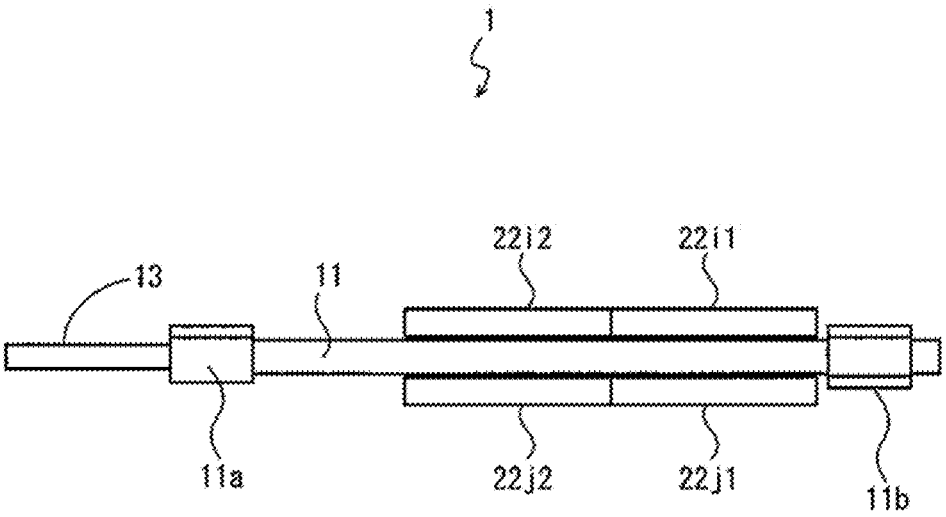
FIG. 15 is a schematic diagram of the initial state of the low recoil firearm concerning a modified example.
Figure 16:
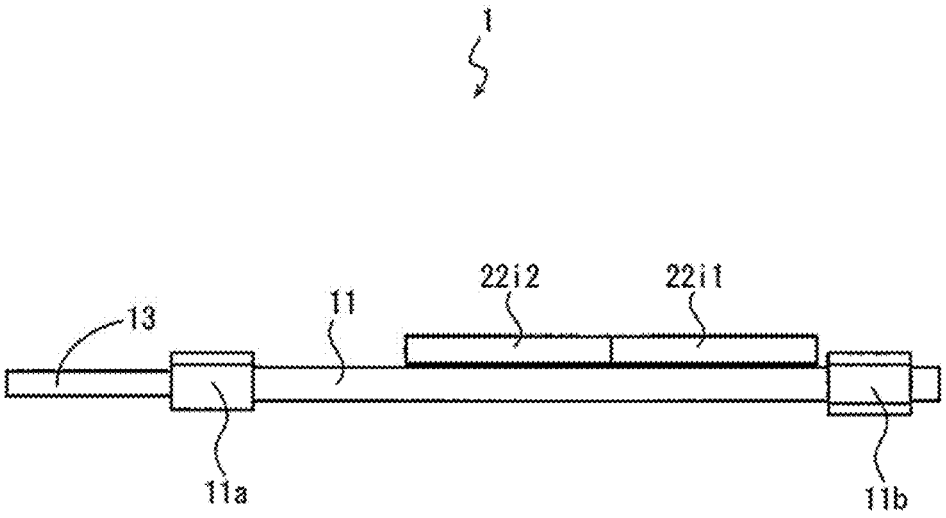
FIG. 16 is a schematic diagram of the initial state of the low recoil firearm concerning a modified example.
Figure 17:
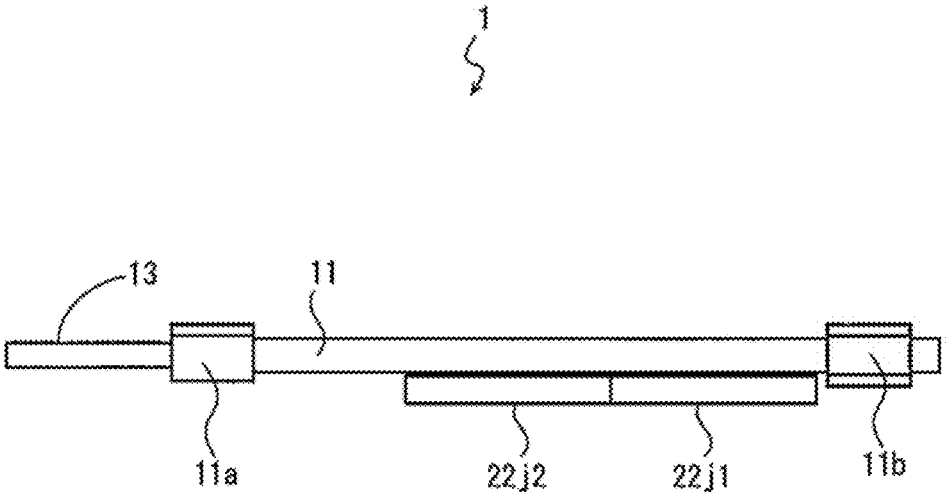
FIG. 17 is a schematic diagram of the initial state of the low recoil firearm concerning a modified example.

FIG. 15 to FIG. 17 show the initial state of the low recoil firearm by a schematic diagram concerning a modified example where the counterweights are arranged on the barrel 11. In the modified example shown in FIG. 15, counterweights **22*i*1, 22*i*2 are arranged on an upper side of the barrel 11 and counterweights 22*j*1, 22*j*2 are arranged on a lower side of the barrel 11. In addition, a barrel front end member 11*b* is formed on the barrel 11 at the portion located nearer to the end of the barrel 11 so that the barrel front end member 11*b* abuts on the counterweights 22*i*1, 22*i*2, 22*j*1, 22*j*2 when the barrel 11** is moved by receiving the recoil.

As described above, a plurality of counterweights **22*i*1, 22*i*2, 22*j*1, 22*j*2 is arranged sandwiching the axial line of the trajectory and facing with each other. Consequently, the counterweights 22*i*1, 22*i*2, 22*j*1, 22*j*2 are located at the position sandwiching the axial line of the trajectory when the barrel 11 transmits the recoil to the counterweights 22*i*1, 22*i*2, 22*j*1, 22*j*2 and the counterweights 22*i*1, 22*i*2, 22*j*1, 22*j*2 are stopped. Thus, at least the barrel 11** does not displace the axial line of the trajectory in the vertical direction and the trajectory of the bullet is not affected.

In the modified example shown in FIG. 16, only the counterweights **22*i*1, 22*i*2 are arranged on an upper side of the barrel 1. In the modified example shown in FIG. 17, only the counterweights 22*j*1, 22*j*2 are arranged on a lower side of the barrel 11. Since the low recoil firearm is not symmetrical in the vertical direction, the recoil can be reduced as a whole with good balance by arranging the counterweights 22*i*1, 22*i*2, 22*j*1, 22*j*2 on the upper side or the lower side of the barrel 11**.

Figure 18:
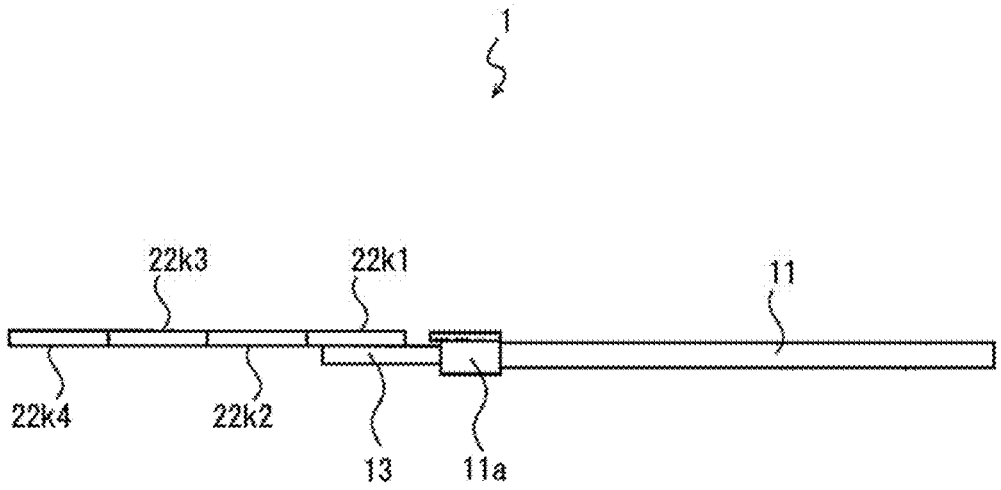
FIG. 18 is a schematic diagram of the initial state of the low recoil firearm concerning a modified example.

FIG. 18 is a schematic diagram of the initial state of the low recoil firearm concerning a modified example.

In the previous examples, the number of the counterweights is two. However, the number of the counterweights is not limited to two. It is possible to use four counterweights **22*k*1, 22*k*2, 22*k*3, 22*k*4 as shown in the figure. When the four counterweights 22*k*1, 22*k*2, 22*k*3, 22*k*4 are used, the recoil transmitted from the barrel 11 can be distributed more finely by stopping the counterweights 22*k*1, 22*k*2, 22*k*3, 22*k*4** separately four times. Thus, the recoil felt by the user can be reduced.

Figure 19:
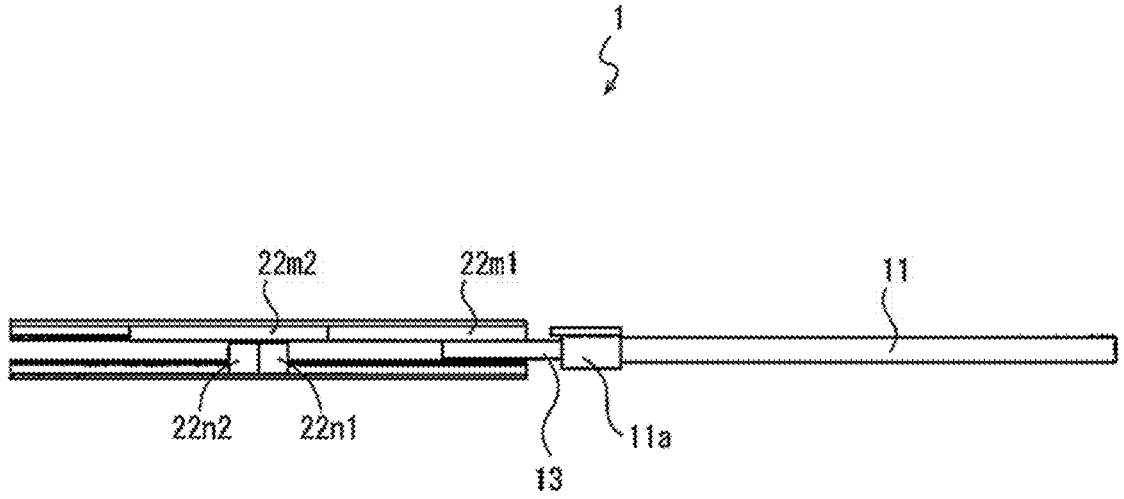
FIG. 19 is a schematic diagram of the initial state of the low recoil firearm concerning a modified example.
Figure 20:
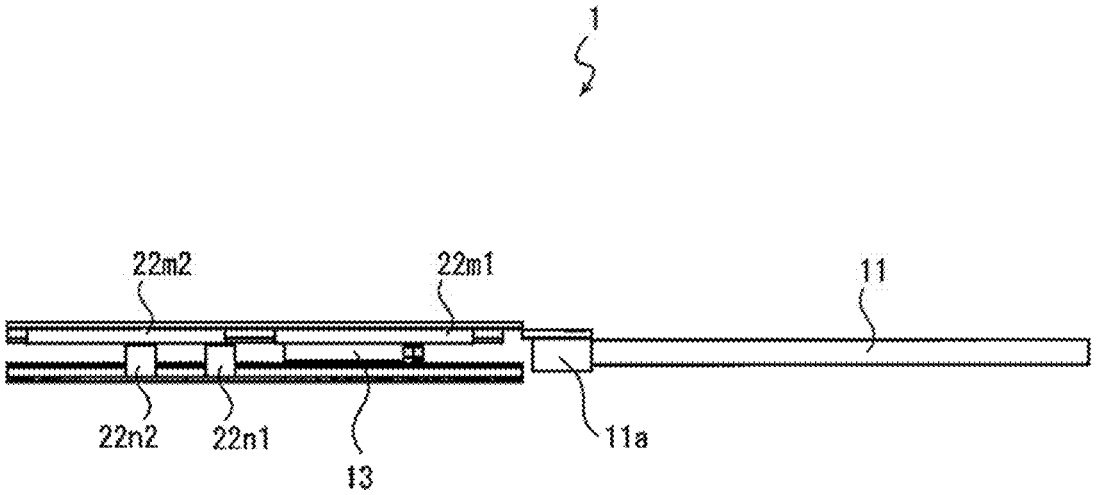
FIG. 20 is a schematic diagram of the stopped state of the low recoil firearm of the modified example.

FIG. 19 and FIG. 20 show the low recoil firearm concerning a modified example by a schematic diagram. FIG. 19 shows the initial state and FIG. 20 shows the stopped state.

This modified example is the low recoil firearm of semi-automatic type. The barrel 11 and the bolt 13 independently receive the recoil and the barrel 11 and the bolt 13 are slid rearward. Each of two pairs of counterweights **22*m*1, 22*m*2 and counterweights 22*n*1, 22*n*2 receives the recoil transmitted from the barrel 11 and the recoil transmitted from the bolt 13**.

The counterweights **22*m*1, 22*m*2 are arranged on an upper side with respect to the trajectory of the barrel 11 as a reference. The counterweights 22*m*1, 22*m*2 are supported by the slide rail 21, which is supported by a not-illustrated frame or the like at the upper side, so that the counterweights 22*m*1, 22*m*2 can be slid in the front-rear direction. In addition, the counterweights 22*m*1, 22*m*2 are provided with the stop mechanism similar to the stop mechanism shown in FIG. 4 to FIG. 6. The counterweights 22*m*1, 22*m*2 receive the recoil when the barrel rear end 11*a*** is retreated.

The counterweights **22*n*1, 22*n*2 are arranged on a lower side with respect to the trajectory of the barrel 11 as a reference. The counterweights 22*n*1, 22*n*2 are supported by the slide rail 21, which is supported by a not-illustrated frame or the like at the lower side, so that the counterweights 22*n*1, 22*n*2 can be slid in the front-rear direction. In addition, the counterweights 22*n*1, 22*n*2 are also provided with the stop mechanism similar to the stop mechanism shown in FIG. 4 to FIG. 6. The counterweights 22*n*1, 22*n*2 receive the recoil when the bolt 13** is retreated.

When the bullet is shot, the barrel 11 begins to move backward and the barrel 11 abuts on the counterweights **22*m*1, 22*m*2, the counterweights 22*m*1, 22*m*2 receive the recoil and begin to move backward. In addition, although the bolt 13 also moves backward when the bullet is shot, the bolt 13 abuts on the counterweights 22*n*1, 22*n*2 after the bolt 13 moves by a predetermined distance. Thus, the counterweights 22*n*1, 22*n*2** receive the recoil and begin to move backward.

Similar to the other examples, the counterweights **22*m*1, 22*m*2 and the counterweights 22*n*1, 22*n*2** are stopped with a time difference from each other. Although the user of the low recoil firearm receives the recoil when the counterweights are stopped, since the user receives the distributed recoil, the user feels that the recoil is low.

By adopting the above described configuration, fine adjustment can be performed by the counterweights **22*m*1, 22*m*2 and the counterweights 22*n*1, 22*n*2 depending on the barrel 11 and the bolt 13**. Thus, the recoil transferred to the user can be reduced.

As described above, the low recoil firearm includes a plurality of members (the barrel 11 and the bolt 13) for causing a recoil, and a group of the plurality of counterweights (the counterweights **22*m*1, 22*m*2 and the counterweights 22*n*1, 22*n*2**) is independently provided on each of the plurality of members for causing the recoil.

Figure 21:
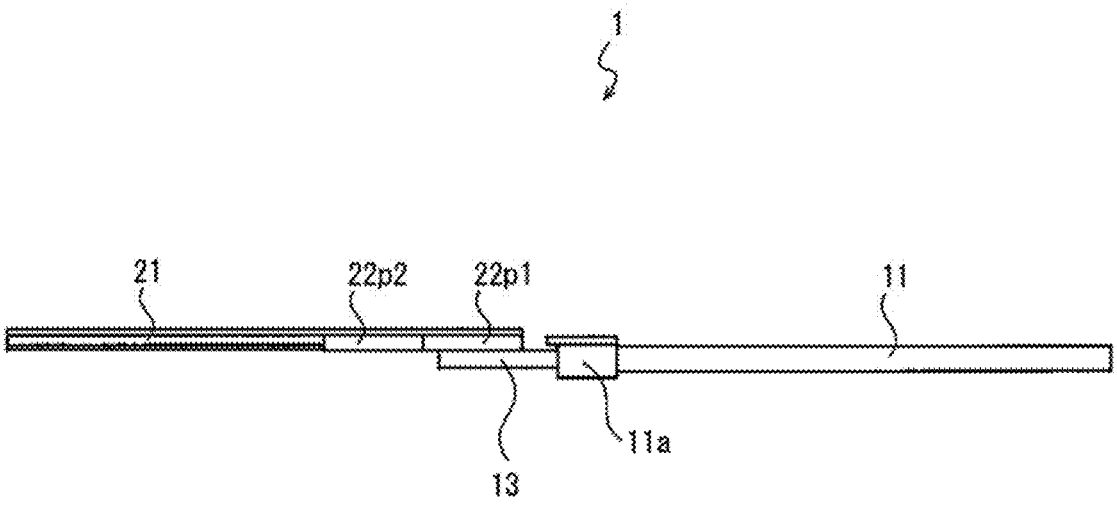
FIG. 21 is a schematic diagram of the initial state of the low recoil firearm concerning a modified example.

FIG. 21 is a schematic diagram of the initial state of the low recoil firearm concerning a modified example.

The weight of the counterweights **22*p*1, 22*p*2** is smaller than the weight of the counterweights shown above. It is not necessarily beneficial to increase the weight of the counterweights as heavy as possible. The weight of the counterweights should be adjusted depending on the low recoil firearm.

Figure 22:
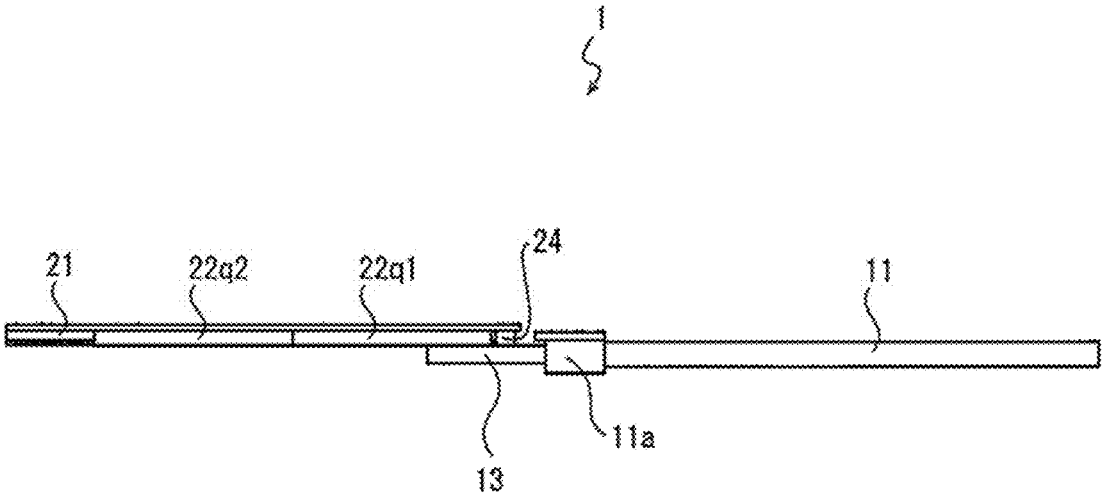
FIG. 22 is a schematic diagram of the initial state of the low recoil firearm concerning a modified example.
Figure 23:
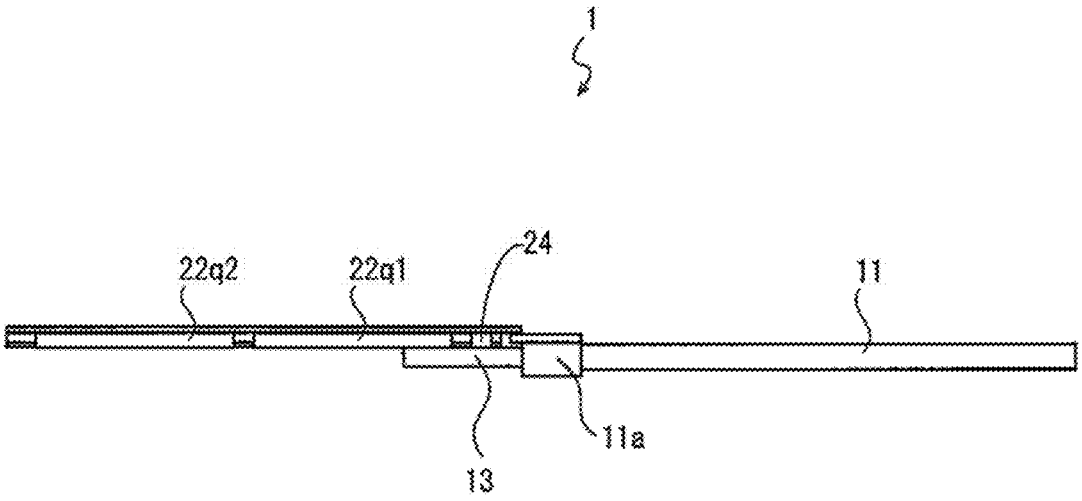
FIG. 23 is a schematic diagram of the stopped state of the low recoil firearm of the modified example.

FIG. 22 and FIG. 23 show the low recoil firearm concerning a modified example by a schematic diagram. FIG. 22 shows the initial state and FIG. 23 shows the stopped state.

In the previous examples, the barrel rear end **11*a* moves rearward and directly abuts on the counterweights or the bolt 13 moves rearward and directly abuts on the counterweights. On the other hand, in this modified example, a buffer material 24 is arranged between the barrel rear end 11*a* and counterweights 22*q*1, 22*q*2. The buffer material 24 is formed of a hard resin or aluminum, for example. The material of the buffer material 24 is selected from the materials softer than the barrel rear end 11*a* and the counterweights 22*q*1, 22*q*2**.

In the initial state shown in FIG. 22, a clearance is formed between the barrel rear end 11*a* and the buffer material 24, and a clearance is also formed between the buffer material 24 and the counterweights 22*q*1, 22*q*2. When the bullet is shot, the barrel 11 begins to move backward by the recoil, the barrel rear end 11*a* abuts on the buffer material 24 first and the barrel 11 further moves backward together with the buffer material 24. When the buffer material 24 abuts on the counterweight 22*q*1, the recoil received by the barrel 11 is instantaneously transmitted to the counterweights 22*q*1, 22*q*2.

At this time, even if the impact is applied to the barrel rear end 11*a* and the counterweights 22*q*1, 22*q*2, since the buffer material 24 is made of the material softer than the barrel rear end 11*a* and the counterweights 22*q*1, 22*q*2, the barrel rear end 11*a* and the counterweights 22*q*1, 22*q*2 are not damaged.

After that, the counterweights 22*q*1, 22*q*2 are sequentially stopped after a minute time by the stop mechanism. Thus, the recoil is distributed.

As described above, the low recoil firearm includes the barrel rear end 11*a* for causing the recoil and the buffer material 24 is placed between the counterweights 22*q*1, 22*q*2 and the barrel rear end 11*a*.

Note that it goes without saying that the present invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

DESCRIPTION OF THE REFERENCE NUMERALS

1: low recoil firearm; 11: barrel; 11*a*: barrel rear end; 11*b*: barrel front end member; 12: part of frame; 12*f*: female screw hole; 13: bolt; 21: slide rail; 21*a*: planar portion; 21*b*: columnar portion; 22 (22*a*, 22*a*1, 22*a*2, 22*b*, 22*b*1, 22*b*2, 22*g*1, 22*g*2, 22*h*1, 22*h*2, 22*i*1, 22*i*2, 22*j*1, 22*j*2, 22*k*1, 22*k*2, 22*k*3, 22*k*4, 22*m*1, 22*m*2, 22*n*1, 22*n*2, 22*p*1, 22*p*2, 22*q*1, 22*q*2) . . . counterweights; 22*c* . . . groove; 22*d* . . . circular recessed portion; 22*e* . . . through hole; 22*e*1 . . . large diameter portion; 22*e*2 . . . small diameter portion; 22*f* . . . female screw hole; 23 . . . bolt; 23*a* . . . head portion; 23*b* . . . screw portion; 24 . . . buffer material

The invention claimed is:

1. A low recoil firearm provided with a plurality of counterweights, wherein the number of the plurality of counterweights is two or more, and a stop mechanism for stopping the plurality of counterweights with a time difference from each other is provided, and the plurality of counterweights is configured to move from a first state where the counterweights are in contact with each other to a second state where the counterweights are separated from each other.

2. The low recoil firearm according to claim 1, wherein weights of the plurality of counterweights are equal to each other.

3. The low recoil firearm according to claim 1, wherein weights of the plurality of counterweights are different from each other.

4. The low recoil firearm according to claim 1, wherein the plurality of counterweights is arranged to surround an axial line of a trajectory.

5. The low recoil firearm according to claim 1, wherein the plurality of counterweights is arranged to sandwich an axial line of a trajectory.

6. The low recoil firearm according to claim 1, wherein the low recoil firearm includes a member for causing a recoil, and a buffer material is arranged between the plurality of counterweights and the member for causing the recoil.

7. The low recoil firearm according to claim 1, wherein the low recoil firearm includes a plurality of members for causing a recoil, and a group of the plurality of counterweights is independently provided on each of the plurality of members for causing the recoil.

8. The low recoil firearm according to claim 1, wherein the plurality of counterweights is connected with each other so that the plurality of counterweights can be separated from each other by a predetermined distance in a moving direction.

9. The low recoil firearm according to claim 1, wherein the plurality of counterweights is configured to be stopped independently from each other.

10. The low recoil firearm according to claim 1, wherein the plurality of counterweights is configured to be stopped by making the counterweights collide with the stop mechanism.

11. The low recoil firearm according to claim 1, wherein the plurality of counterweights is configured to be stopped by making the counterweights slide on the stop mechanism.

* * * * *